US007101332B2

(12) United States Patent
Trovinger

(10) Patent No.: US 7,101,332 B2
(45) Date of Patent: Sep. 5, 2006

(54) SHEET FOLDING AND TRIMMING APPARATUS

(75) Inventor: Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 427 days.

(21) Appl. No.: 10/681,315

(22) Filed: Oct. 9, 2003

(65) Prior Publication Data

US 2005/0079968 A1 Apr. 14, 2005

(51) Int. Cl.
*B41L 43/02* (2006.01)

(52) U.S. Cl. ..... 493/420; 493/374; 270/37; 270/51; 270/52.18

(58) Field of Classification Search ..... 493/334, 493/374, 383, 420; 270/32, 37, 51, 52.18
See application file for complete search history.

(56) References Cited

U.S. PATENT DOCUMENTS 4,221,373 A 9/1980 Muller Hans
4,484,501 A 11/1984 Ramcke
4,575,296 A 3/1986 Kockler et al.
4,595,187 A 6/1986 Bober
4,795,071 A 1/1989 Jacobs et al.
5,028,193 A 7/1991 Misicka
5,377,965 A 1/1995 Mandel et al.
5,457,904 A * 10/1995 Colvin ..... 40/119
5,632,587 A 5/1997 Coyette
5,662,318 A 9/1997 Harada et al.
5,678,813 A * 10/1997 Osako et al. ..... 270/52.16
5,803,891 A 9/1998 Haan et al.
6,099,225 A 8/2000 Allen et al.
6,709,374 B1 * 3/2004 Neubauer et al. ..... 493/405
2002/0106264 A1 8/2002 Cobene
2002/0119029 A1 8/2002 Cobene
2003/0214092 A1 * 11/2003 Horii et al. ..... 270/52.18
2005/0020425 A1 * 1/2005 Kawatsu et al. ..... 493/424

FOREIGN PATENT DOCUMENTS

WO WO 0018583 4/2000

* cited by examiner

*Primary Examiner*—Hermant M. Desai

(57) ABSTRACT

A sheet folding and trimming apparatus for a booklet maker or bookbinder includes a folding apparatus and a sheetwise trimming apparatus configured to trim the folded sheet from the folding apparatus on three unfolded sides of the sheet in a sheetwise manner. The location of the sheet folder prior to the sheet trimmer allows the use of a relatively imprecise and inexpensive folding apparatus, such as a buckle folder, and adjusts for the imprecision of the fold by trimming the folded sheet.

20 Claims, 4 Drawing Sheets

SHEET FOLDING AND TRIMMING APPARATUS

FIELD OF THE INVENTION

The invention relates to a desktop booklet maker or desktop bookbinding system and more particularly, the invention relates to an apparatus and method for folding and trimming the folded sheets to form a book or booklet.

DESCRIPTION OF THE RELATED ART

Today, a variety of different booklet making and bookbinding systems can deliver professional bound documents, including books, manuals, publications, annual reports, newsletters, business plans, and brochures. A bookbinding or booklet making system generally may be classified as a commercial (trade) system that is designed for in-line manufacturing of high quality volume runs or an in-house (office or desktop) system designed for short "on-demand" runs.

Commercial bookbinding systems generally provide a wide variety of binding capabilities, but require large production runs (e.g., on the order of thousands of bindings) to offset the set-up cost of each production run and to support the necessary investment in expensive in-line production equipment. Commercial systems also require high power cutting devices for trimming the edges of the sheets.

Office bookbinding systems and desktop booklet making systems, on the other hand, generally involve manual intervention and provide relatively few binding capabilities, but are significantly less expensive to set up and operate than commercial bookbinding systems, even for short on-demand production runs of only a few books or booklets.

A system for finishing printed sheets into booklets is described in PCT Document No. WO 00/18583 (hereafter referred to as "the Trovinger PCT"), hereby incorporated by reference in its entirety. The Trovinger PCT describes a desktop booklet maker in which sheets are trimmed on a sheet-by-sheet basis to avoid the need for high powered cutting devices. The trimmed sheets are then folded and stapled into the finished booklet.

Mechanical folding of sheets involves doubling the sheet between rollers while applying pressure appropriate to the thickness of the paper to create a sharp fold that substantially eliminates the paper's natural tendency to revert to its original shape. There are two commonly used techniques for mechanical folding including knife folding and buckle plate folding.

Knife folding uses a moving knife which moves between two rollers rotated in opposite directions. The moving knife plugs the sheet in-between the rollers which have been set to the thickness of the sheet going between them. As the sheet passes through the rollers, it is pinched and the fold is formed.

The Trovinger PCT describes a knife folding apparatus using two drive motor assemblies. A first vertical drive motor assembly operates to immobilize a sheet by pressing it against a fold blade with a folder assembly. This first vertical drive motor assembly moves a set of fold rollers into contact with both the sheet and a longitudinal fold blade. The axes of rotation for the fold rollers are perpendicular to the fold blade used to fold each sheet. A second horizontal drive motor then operates to deform the sheet against the fold blade by reciprocating the set of fold rollers, which have been placed into contact with the sheet, back and forth along the fold blade to crease the sheet. The number and spacing of these fold rollers are such that during horizontal movement of the fold rollers, at least one fold roller passes over every point along the portion of a sheet where a fold is to be formed.

Although a knife folding apparatus provides a precisely located fold, this apparatus is complicated and expensive due to the need for a translating knife and/or movable rollers. Where a less precise fold is required, it is possible to use an alternative folding method known as buckle folding.

One buckle folding system includes three rollers and a buckle plate. The first two rollers are arranged vertically one above the other to deliver the incoming sheet into a slot in the buckle plate until it reaches a feed guide stop. Once the paper stops in the buckle plate, the sheet continues to be fed creating a buckle in the space between the rollers and the buckle plate. As the excess paper accumulates adjacent the buckle plate, the excess paper is driven between the lower incoming roller and the third roller to form a fold.

Unlike knife folding, buckle folding does not require the cyclical movement of the knife or rollers which makes the folding process with a buckle folder faster and less expensive. However, with buckle folding it is more difficult to achieve a precisely located fold. For the desktop booklet making systems and office bookbinding systems the speed of a buckle folding system would be desirable if the problem of the imprecise fold could be addressed.

It would be desirable to reduce the apparatus cost and the time required to form a fold in a desktop booklet making system or an office bookbinding system.

SUMMARY OF THE INVENTION

The present invention relates to a folding and trimming system using a relatively imprecise folding apparatus in combination with a trimming apparatus which adjusts for the imprecision of the fold by trimming the folded sheet.

In accordance with one aspect, a sheet folding and trimming apparatus includes a folding apparatus including a plurality of rollers for forming a fold in a sheet, and a sheetwise trimming apparatus including at least one cutting blade configured to trim the folded sheet from the folding apparatus on three unfolded sides of the folded sheet in a sheetwise manner.

In accordance with another aspect, a booklet making apparatus includes a folding apparatus including a plurality of rollers configured to form a folded sheet, a sheetwise trimming apparatus including at least one cutting blade configured to trim the folded sheet from the folding apparatus on three unfolded sides of the folded sheet in a sheetwise manner, and an assembling apparatus for assembling a plurality of folded and trimmed sheets into a booklet, the assembling apparatus including an opening roller for opening the folded and trimmed sheets and an advancing apparatus for advancing a sheet into an opened sheet.

In accordance with a further aspect, a method of forming a bound text body includes the steps of:

(a) folding a sheet with a folding apparatus to form a folded sheet;

(b) trimming three edges of the folded sheet to form edges that a square with the fold;

(c) repeating steps (a) and (b) with a plurality of sheets;

(d) assembling the plurality of folded and trimmed sheets into a text body; and (e) binding the text body.

BRIEF DESCRIPTION OF THE DRAWING FIGURES

The invention will now be described in greater detail with reference to the preferred embodiments illustrated in the accompanying drawings, in which like elements bear like reference numerals, and wherein.

DETAILED DESCRIPTION OF THE INVENTION

Figure 1:
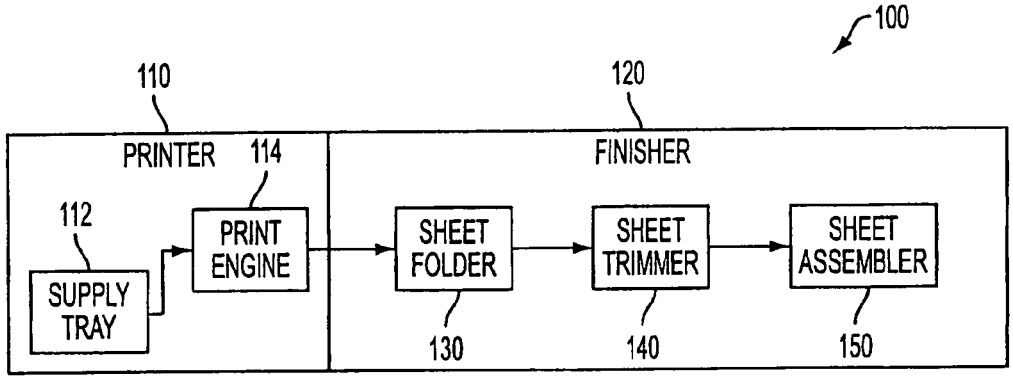
FIG. 1 is a schematic view of a system for forming bound text bodies.

A system 100 for forming a bound text body is shown in FIG. 1 including a printer 110 and a finisher 120. The printer 110 includes a supply tray 112 for providing sheets of material and a print engine 114 for printing on the sheets. The printer 110 delivers the printed sheets to the finisher 120 which assembles and binds the sheets into a bound text body. The bound text body may be either a booklet or a book as will be described herein. The finisher 120 is a desktop or office type finisher which includes a sheet folder 130, a sheet trimmer 140, and a sheet assembler 150.

Figure 2:
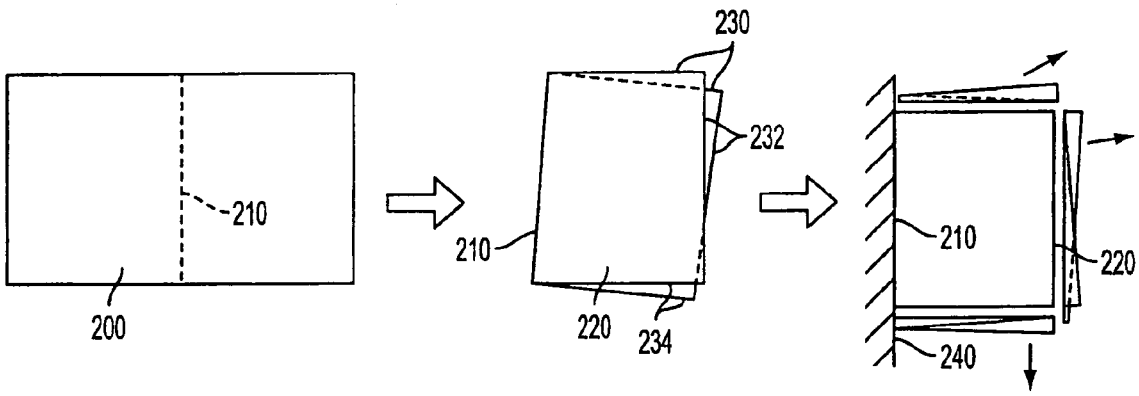
FIG. 2 is a diagram of a sheet folding and trimming process.

The location of the sheet folder 130 prior to the sheet trimmer 140 allows the use of a relatively imprecise and inexpensive folding apparatus and adjusts for the imprecision of the fold by trimming the folded sheet. FIG. 2 illustrates a sheet 200 which is folded along a fold line 210 in a relatively imprecise manner such that a folded sheet 220 has edges 230, 232, 234 which are misaligned. Following folding with the sheet folder 120 the folded sheet 220 is placed with the fold 210 against a datum surface 240 and the edges 230, 232, 234 are trimmed to create a trimmed sheet slightly smaller than the original folded sheet with even and square edges.

Figure 3A:
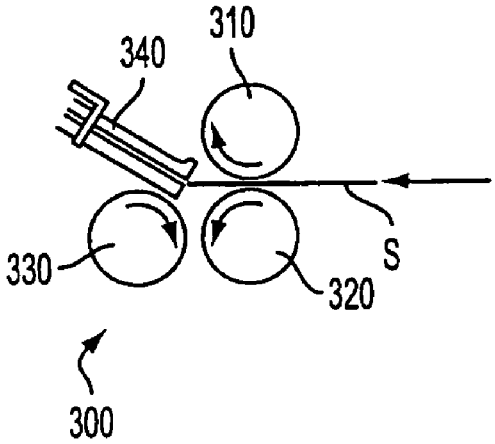
FIGS. 3A–3D are schematic illustrations of the sheet folding process using a buckle folding apparatus.
Figure 3B:
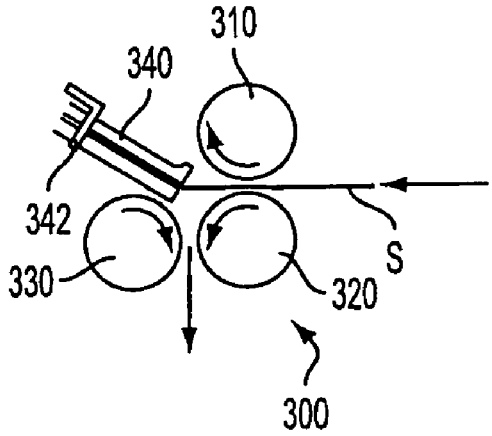
Figure 3C:
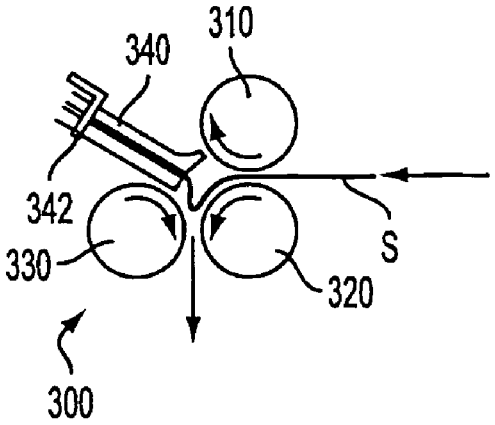
Figure 3D:
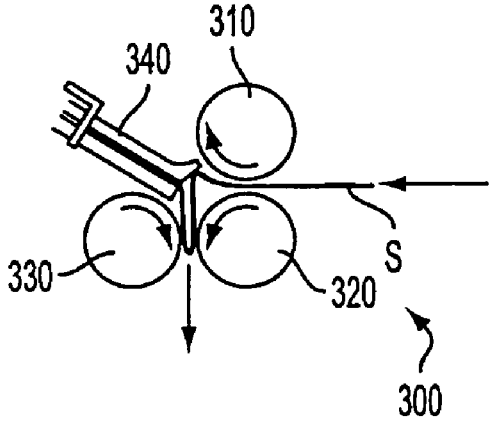

In one embodiment, the sheet folder 130 is a buckle folding apparatus 300 as shown in FIGS. 3A–3D. The buckle folding apparatus 300 includes a first roller 310, a second roller 320, a third roller 330, and a sheet holder 340. The first and second rollers 310, 320 act as advancing rollers for delivering a sheet S to the sheet holder 340. Once the sheet S hits a sheet stop 342 of the sheet holder 340, as shown in FIG. 3B, the sheet begins to buckle downward as shown in FIG. 3C. The buckled sheet in the embodiment of FIGS. 3A–3D moves downward into a space between the second and third rollers 320, 330 which function as folding rollers. As shown in FIG. 3D, the folding rollers 320, 330 grab the buckled sheet S and pull it through a gap between the rollers forming the fold. The sheet is then ejected between the folding rollers 320, 330 and another sheet is fed into the folding apparatus 300.

The buckle folding apparatus 300 illustrated in FIG. 3A–3D is one example of the type of paper folding apparatus which may be used in the present invention. Any other conventional folding apparatus can also be used. The buckle folding apparatus eliminates the need for a knife edge for folding or for other translating parts. Other types of folding apparatus which may be used can create a relatively imprecise fold without the requirement for adjustments of the folding machine for each run of a book or booklet. The system for binding as described herein recognizes the lack of precision in this type of roller folding device and creates a sheet with a sharply aligned fold and edges by a trimming operation subsequent to the folding operation.

As shown in FIG. 2, the folded sheet 220 is aligned with the fold 210 against a datum surface 240 so that trimming can be performed to create the precisely square final edges of the sheet. Although the datum surface 240 is described for locating the sheet other means of locating the sheet may also be used.

Figure 4:
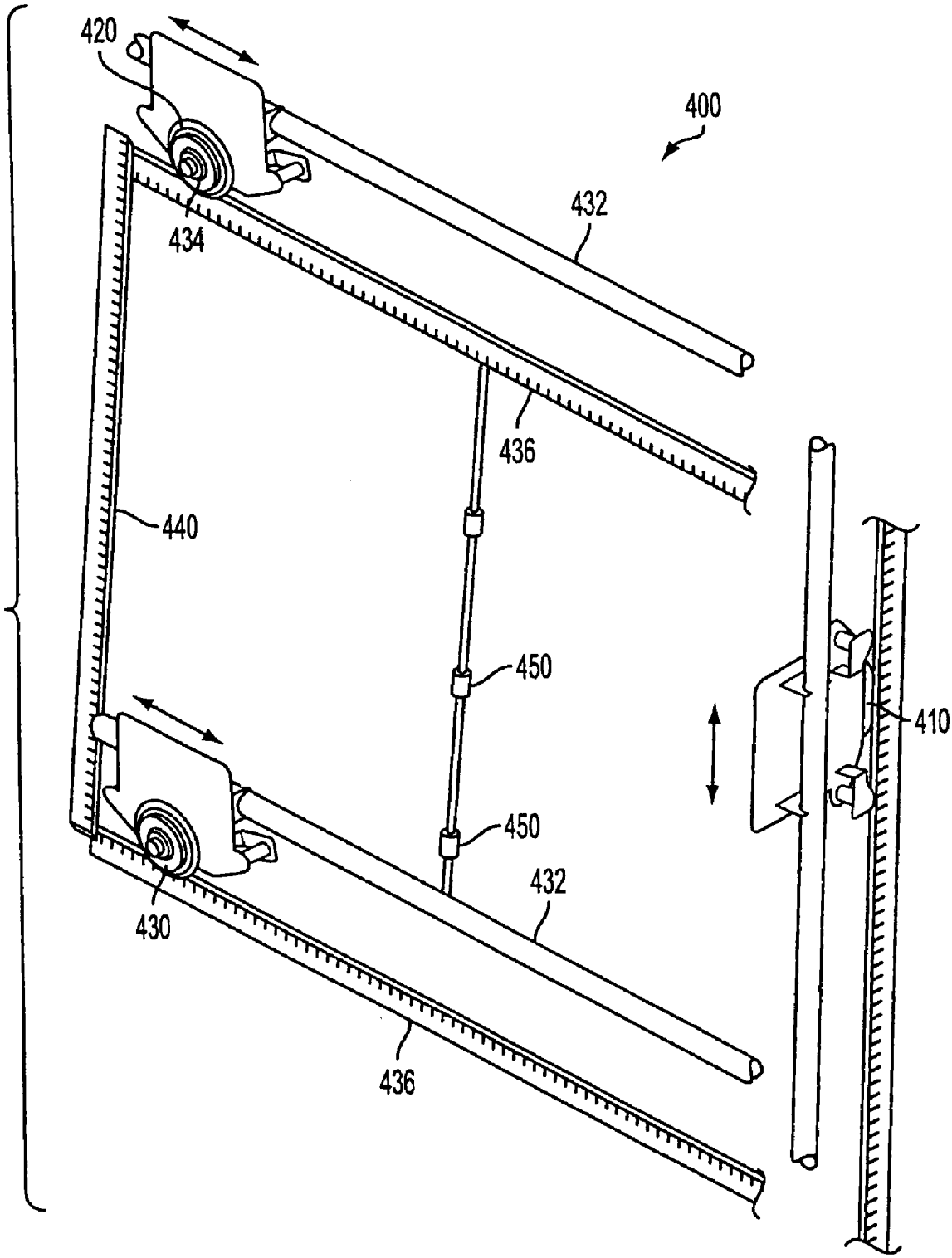
FIG. 4 is a perspective view of a sheet trimming apparatus for trimming folded sheets.

FIG. 4 illustrates one example of a sheetwise trimming apparatus for trimming the uneven sides of the folded sheet. Once the fold 210 is aligned to the datum 240 using conventional paper drive means, the trailing edges 232 of the folded sheet can be cut using a low power, few sheet cutting device, such as a rotary blade. In a similar fashion, the uneven side edges 230, 234 can be cut using a similar cutter to form the sides 230, 234 perpendicular to the fold 210 and the trailing edge 232.

The term "sheetwise trimming" as used herein means the trimming of single folded sheets or a small number of sheets with a low powered trimming device. The sheets trimmed with a sheetwise trimming apparatus are trimmed separately then assembled and bound into a text body.

FIG. 4 illustrates one example of a trimming apparatus 400 including a first cutter 410 arranged parallel to the datum surface 440. Second and third cutters 420, 430 are positioned perpendicular to the datum surface 440 for cutting the sides of the sheets. The cutters 410, 420, 430 illustrated in FIG. 4 are rotary cutters which are each translatable along an associated rod 432 to move the rotary cutting blade 434 along a cutting edge 436. According to one embodiment, one of the second and third cutters 420, 430 are movable in a direction parallel to the datum 440 to adjust the trimming apparatus 400 for sheets of different sizes. The first cutter 410 may also be adjustable in the direction perpendicular to the datum 440 to adjust for different paper sizes.

When the trimming apparatus 400 is used to create folded sheets for use in the formation of a booklet, the cutter 410 for trimming the trailing edge of the sheet is movable to allow a size of the trimmed sheets to be adjusted on a sheet-by-sheet basis based on a trim schedule which adjusts the size of the sheets depending on a location of the sheet in a booklet and a thickness of the sheet material. Examples of trim schedules are described in the Trovinger PCT which was previously incorporated herein by reference.

The sheets are transported from the sheet folder 130 to the sheeting trimmer 140 and then to the sheet assembler 150 by a transport system including conventional feed rollers 450.

Formation of a Booklet

Figure 5A:
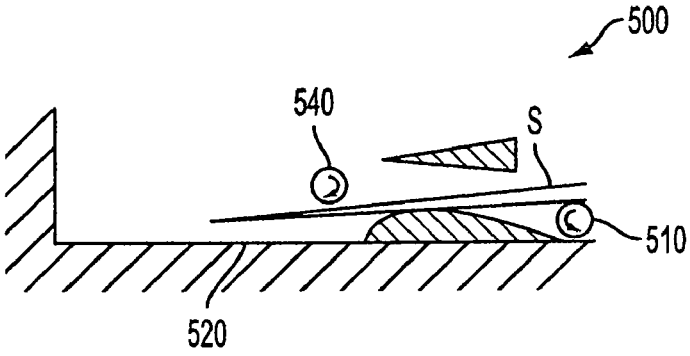
FIGS. 5A–5D are schematic side views of an assembling apparatus illustrating the steps of assembling folded and trimmed sheets into a booklet.
Figure 5B:
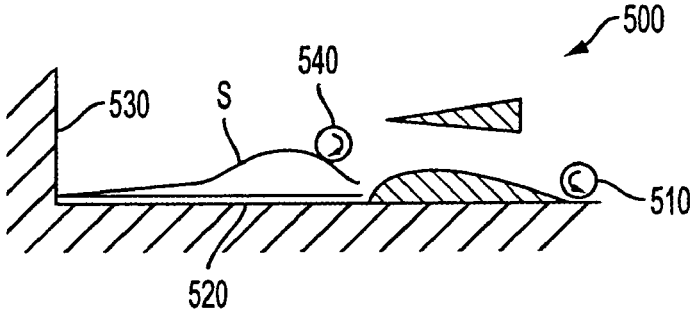
Figure 5C:
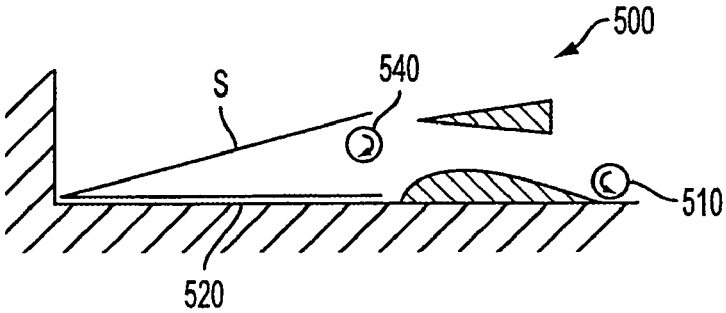
Figure 5D:
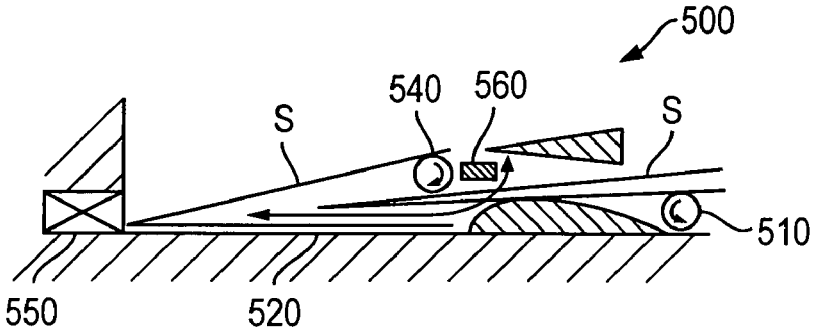

When the trimmed and folded sheets are to be assembled into a booklet, the sheets can be opened and stacked and then stapled along the fold. One example of a mechanism for opening and stacking folded sheets into a booklet is shown in FIGS. 5A–5D. One example of an assembling apparatus 500 for assembling a plurality of folded and trimmed sheets into a booklet includes a sheet transporting mechanism 510 or feed roller for delivering a folded sheet S into a sheet receiving tray 520 as shown in FIG. 5A. When the sheet S reaches an end 530 of the sheet receiving tray 520, as shown in FIG. 5B, an opening roller 540 lifts a top page of the folded sheet. FIG. 5C illustrates an open sheet S which is ready for delivery of a second sheet into a center of the folded sheet. FIG. 5D illustrates the delivery of a second sheet S into the middle of the opened first sheet. In this manner a plurality of folded sheets can be opened and assembled into a booklet in preparation for stapling in a known manner. The stapling apparatus may be incorporated in the assembling apparatus 500 by providing a stapling cartridge 550 and a movable anvil 500.

Bookbinding System

The systems for folding and trimming a sheet described in FIGS. 2–4 above can also be used for formation of a book in an office type bookbinding system. In a bookbinding system, the step of assembling sheets with a sheet assembler 150 includes stacking the folded and trimmed sheets into a text body in a known manner and binding the folded edges of the sheet with a bookbinding apparatus in a known manner, such as applying an adhesive. One example of an adhesive applicator is described in U.S. Patent Publication No. 2002/0106264, which is incorporated herein by reference in its entirety. A cover may also be by a system such as that disclosed in U.S. Patent Publication No. 2002/0119029 which is incorporated herein by reference in its entirety.

The use of an imprecise sheet folding apparatus followed by three-sided trimming, provides the advantages of faster and cheaper sheet folding for a desktop system. The system also allows for a full bleed sheet in the final text body because the margins can be removed when performing the three-sided trimming. The sheet folding followed by trimming can also eliminate any sheet-to-sheet variations that exist in a ream of paper and result in a much more even finished book or booklet.

While the invention has been described in detail with reference to the preferred embodiments thereof, it will be apparent to one skilled in the art that various changes and modifications can be made and equivalents employed, without departing from the present invention.

What is claimed is:

1. A sheet folding and trimming apparatus comprising:

a folding apparatus including a plurality of rollers for forming a fold in a sheet; and a sheetwise trimming apparatus including at least one cutting blade configured to trim the folded sheet from the folding apparatus on three unfolded sides of the folded sheet in a sheetwise manner.

2. The apparatus of claim 1, wherein the folding apparatus is a buckle folding apparatus having a sheet holder and the plurality of rollers are configured to form a folded sheet by advancing one portion of the sheet while holding another portion of the sheet with the sheet holder.

3. The apparatus of claim 2, wherein the plurality of rollers of the buckle folding apparatus include two advancing rollers for delivering the sheet to the sheet holder and two folding rollers for forming the fold.

4. The apparatus of claim 3, wherein one of the two advancing rollers functions as one of the two folding rollers.

5. The apparatus of claim 1, comprising a transport system configured to transport sheets to the folding apparatus and to transport folded sheets from the folding apparatus to the sheetwise trimming apparatus.

6. The apparatus of claim 5, wherein the at least one cutting blade of the sheetwise trimming apparatus is movable with respect to the transport system to cut sheets of different sizes.

7. The apparatus of claim 1, comprising an assembling apparatus for assembling a plurality of folded and trimmed sheets into a booklet, the assembling apparatus including an opening roller for opening the folded and trimmed sheets and an advancing apparatus for advancing a sheet into an opened sheet.

8. The apparatus of claim 1, comprising an assembling apparatus for assembling a plurality of folded and trimmed sheets into a text body, the assembling apparatus including a stacking module for stacking the folded and trimmed sheets for binding.

9. The apparatus of claim 1, wherein the folding apparatus is a knifeless folding device.

10. The apparatus of claim 1, wherein the sheetwise trimming apparatus performs trimming on first and second opposite edges of the folded sheet at a predetermined fixed location determined by the size of a booklet to be formed, and the trimming apparatus performs trimming on a third edge of the folded sheet at a variable location determined on a sheet-by-sheet basis based on a size of the booklet and a location of the sheet in the booklet.

11. The apparatus of claim 1, comprising a printer arranged to deliver printed sheets to the folding apparatus.

12. A booklet making apparatus comprising:

a folding apparatus including a plurality of rollers configured to form a folded sheet;

a sheetwise trimming apparatus including at least one cutting blade configured to trim the folded sheet from the folding apparatus on three unfolded sides of the folded sheet in a sheetwise manner; and an assembling apparatus for assembling a plurality of folded and trimmed sheets into a booklet, the assembling apparatus including an opening roller for opening the folded and trimmed sheets and an advancing apparatus for advancing a sheet into an opened sheet.

13. The apparatus of claim 12, wherein the sheetwise trimming apparatus performs trimming on first and second opposite edges of the folded sheet at a predetermined fixed location determined by the size of a booklet to be formed, and the trimming apparatus performs trimming on a third edge of the folded sheet at a variable location determined on a sheet-by-sheet basis based on a size of the booklet and a location of the sheet in the booklet.

14. The apparatus of claim 12, wherein the at least one cutting blade of the sheetwise trimming apparatus is movable to cut sheets of different sizes.

15. A method of forming a bound text body comprises:

(a) folding a sheet with a folding apparatus to form a folded sheet;

(b) trimming three edges of the folded sheet to form edges that a square with the fold;

(c) repeating steps (a) and (b) with a plurality of sheets;

(d) assembling the plurality of folded and trimmed sheets into a text body; and (e) binding the text body.

16. The method of claim 15, wherein the step of assembling includes opening the folded sheets and assembling the sheets in the form of a booklet.

17. The method of claim 16, wherein the step of assembling includes stapling the booklet along the fold.

18. The method of claim 16, wherein the step of trimming includes trimming the sheets to different sizes depending on a location of the sheet in the final booklet.

19. The method of claim 15, wherein the step of assembling includes stacking the folded sheets in the form of a book and the step of binding includes applying adhesives to the folds of the sheets.

20. The method of claim 15, wherein the step of folding the sheet includes holding a portion of the sheet stationary while advancing another portion of the sheet with a plurality of rollers to form a buckle in the sheet.

* * * * *